US008245892B2

(12) United States Patent
Kriner

(10) Patent No.: US 8,245,892 B2
(45) Date of Patent: Aug. 21, 2012

(54) BELT BUCKLE WITH RETRACTABLE CUP HOLDER

(75) Inventor: Jay P. Kriner, Central City, CO (US)

(73) Assignee: Beer Clothing Company, LLC, Central City, CO (US)

( * ) Notice: Subject to any disclaimer, the term of this patent is extended or adjusted under 35 U.S.C. 154(b) by 751 days.

(21) Appl. No.: 12/248,745

(22) Filed: Oct. 9, 2008

(65) Prior Publication Data

US 2010/0032461 A1 Feb. 11, 2010

Related U.S. Application Data

(60) Provisional application No. 61/087,686, filed on Aug. 9, 2008.

(51) Int. Cl.
*A45F 3/16* (2006.01)
*A45F 5/00* (2006.01)
*A45F 3/00* (2006.01)

(52) U.S. Cl. ..... 224/163; 224/148.4; 224/183; 224/676

(58) Field of Classification Search ..... 224/163, 224/148.4, 183, 676; 248/311.2
See application file for complete search history.

(56) References Cited

U.S. PATENT DOCUMENTS 1,383,968 A * 7/1921 Perry, Jr. et al. ..... 224/163
2,754,078 A * 7/1956 Koger et al. ..... 248/311.2
3,233,858 A * 2/1966 Benjamin ..... 248/311.2
4,191,350 A * 3/1980 Ormond ..... 248/292.13
4,377,249 A 3/1983 Bockoven
4,434,961 A * 3/1984 Hoye ..... 248/311.2
D279,836 S * 7/1985 Tanaka ..... D12/420
D299,897 S * 2/1989 Rasmussen ..... D7/619.1
4,828,211 A * 5/1989 McConnell et al. ..... 248/311.2
D307,669 S * 5/1990 Inouye ..... D7/620
5,056,696 A 10/1991 Lahr
5,060,835 A 10/1991 Payne
5,102,023 A * 4/1992 Nguyen ..... 224/163
5,139,222 A * 8/1992 Koorey et al. ..... 248/311.2
5,148,926 A * 9/1992 Cocuzzo et al. ..... 211/118
D337,028 S * 7/1993 Koorey et al. ..... D7/620
5,328,143 A * 7/1994 Koorey et al. ..... 248/311.2
5,687,890 A 11/1997 Wanner
6,108,276 A * 8/2000 Chen ..... 368/10
7,300,031 B2 * 11/2007 Bertsch et al. ..... 248/311.2
2004/0099702 A1 5/2004 Conner
2007/0084892 A1 4/2007 Korlath
2007/0090136 A1 * 4/2007 Stowell et al. ..... 224/148.4
2008/0120813 A1 * 5/2008 Su ..... 24/163 K

* cited by examiner

*Primary Examiner* — Nathan J Newhouse
*Assistant Examiner* — Lester L Vanterpool
(74) *Attorney, Agent, or Firm* — Brett T. Cooke; Andrews Kurth LLP

(57) ABSTRACT

An ornamental belt buckle/cup-holder combination having a front plate pivotably connected at its lower end to the lower end of a back plate. The back side of the buckle includes brackets and a hook for securing a belt. The front side of the buckle includes ornamentation. The front and back plates are held in parallel abutment with magnets. A loop is pivotably mounted to the top of the back plate and is captured between the front plate and the back plate when they in parallel abutment. The loop is urged into a upward perpendicular position relative to the back plate with a spring. When the front plate is folded downward perpendicular to the back plate, it forms a lower horizontal surface for supporting the weight of a beverage container. The loop is then urged by the spring into an upper horizontal position for receiving and laterally supporting the beverage container.

16 Claims, 4 Drawing Sheets

BELT BUCKLE WITH RETRACTABLE CUP HOLDER

CROSS REFERENCE TO RELATED APPLICATION

This application is based upon provisional application 61/087,686 filed on Aug. 9, 2008, the priority of which is claimed.

BACKGROUND OF THE INVENTION

1. Field of the Invention

This invention relates generally to clothing accessories, and in particular, to belt buckles. The invention also relates to curios for devotees of potation. Specifically, the invention concerns a novel belt buckle with a holder adapted for carrying beverage containers that retracts into the belt buckle when not in use so as to be hidden from view.

2. Description of the Prior Art

Belt buckles that also function as holders for cups or other beverage containers, such as cans or bottles, are known in the art. For example, U.S. Patent Publication No. 2007/0090136, filed in the name of Stowell et al., discloses a belt buckle formed of a foldable cup-holder of common design. The belt buckle/cup-holder includes a horizontal base for supporting the weight of the beverage and a horizontally-oriented pair of rigid upper arms for capturing and laterally supporting the beverage container. The lower base and upper arms are each pivotably connected to vertical midsection. The upper arms fold down adjacent to the midsection, and the base folds up parallel to the midsection. The base covers the arms and forms the front surface of the belt buckle when the cup-holder function is not used.

While the Stowell et al. belt buckle/cup-holder is suitable for performing its dual role of holding up a wearer's trousers and keeping the wearer's liquid refreshment close at hand, wherever the wearer's whereabouts, the traditional cup-holder elements are difficult to arrange into an aesthetically appealing design. For example, the front and back plates of the Stowell belt buckle include lips about the perimeter that provide spacing between the plates to accommodate the large upper arms, which results in a thick, box-like buckle.

3. Identification of Objects of the Invention

A primary object of the invention is to provide a belt buckle with a retractable cup-holder that is virtually indistinguishable from a typical ornamental belt buckle, such as the popular western style belt buckle, when the cup-holder feature is not in use, so as to increase the cosmetic appeal of the device.

Another object of the invention is to provide a lateral cup support member that is self-propelled into a horizontal cup-holding position so as to achieve a more rapid deployment of the cup-holder and to prevent the cup support member from inadvertently folding down into the stowed position when the cup is temporarily removed from the holder, such as when sipping the beverage.

Another object of the invention is to provide a belt buckle/cup-holder with a latching mechanism for the base plate that securely holds the base plate in an upward folded position when the cup-holder is stowed, that easily unlatches for deploying the cup-holder, and that is fully hidden from view when the cup-holder is stowed.

SUMMARY OF THE INVENTION

The objects described above and other advantages and features of the invention are incorporated in an ornamental belt buckle with a retractable cup-holder including a front plate pivotably connected at its lower end to the lower end of a back plate. The back side of the back plate includes brackets and a hook for securing a belt. The front side of the front plate includes ornamentation.

When in the cup-holder-retracted configuration, the front and back plates are held in parallel abutment with magnets. A loop is pivotably mounted to the top of the back plate and is captured between the front plate and the back plate when they in parallel abutment. The loop is urged into a upward perpendicular position relative to the back plate with a spring. In this configuration, the device resembles an ordinary ornamental belt buckle.

When the front plate is folded downward perpendicular to the back plate, the front plate forms a lower horizontal surface for supporting the weight of a beverage container. The loop, no longer restrained by the front plate, is then urged by the spring into an upper horizontal position for receiving and laterally supporting the beverage container. In this configuration, the belt buckle functions as a holder for a beverage container.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 1:
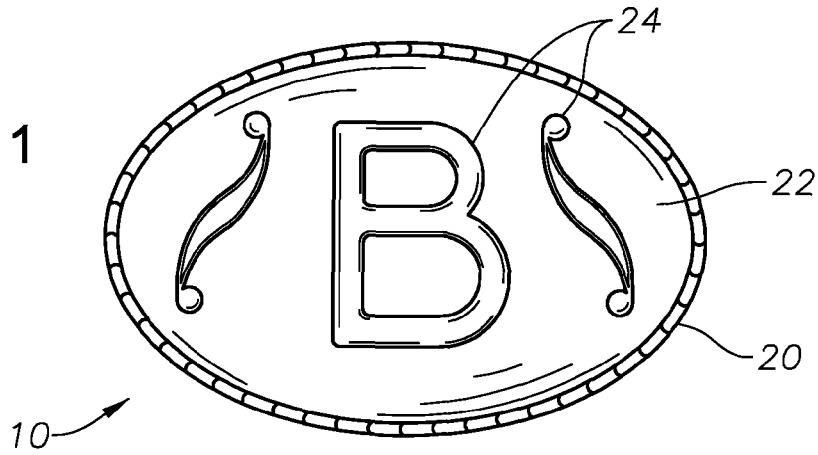
FIG. 1 is an orthogonal front view of a belt buckle/cup-holder device according to a preferred embodiment of the invention shown in the cup-holder-stowed configuration, with the shape and ornamentation of a traditional western-style belt buckle, for example.
Figure 2:
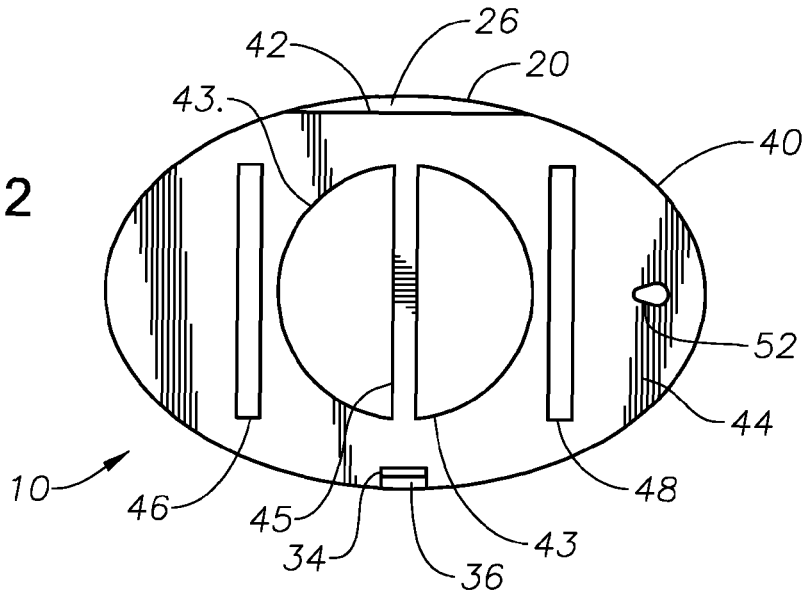
FIG. 2 is an orthogonal back view of the belt buckle/cup-holder device of FIG. 1, showing conventional brackets and a post for securing a belt strap about a wearer.
Figure 3:
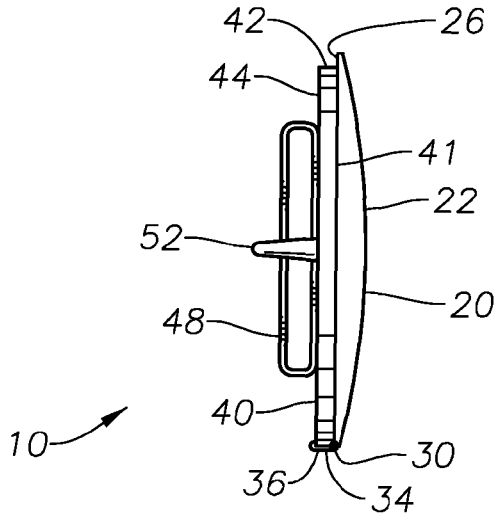
FIG. 3 is an orthogonal right side view of the belt buckle of FIG. 1, showing a thin profile resembling that of a traditional western-style belt buckle, for example.

FIGS. 1-3 illustrate a belt buckle/cup-holder 10 according to a preferred embodiment of the invention, showing the front, back and right side profile of the device configured its ordinary cup-holder-stowed position, respectively. Belt buckle/cup-holder 10 includes a front plate 20 that is pivotally connected to a back plate 40 by a hinge 30.

As shown in FIG. 1, the outer surface 22 of front plate 20 preferably includes ornamental or decorative elements 24 for providing aesthetic appeal. Decorative elements 24 may be formed in three-dimensional relief, embossed, engraved, or otherwise created as is conventionally known in the art. Front plate 20 may be oval-shaped, but other shapes, such as circular or rectangular, for example, may be used as well. As shown in FIG. 3, front plate 20 may also be outwardly convex. Front plate 20 is preferably formed of metal or plastic materials, but other materials may be used.

Referring to FIGS. 2, the back side of belt buckle/cup-holder 10 is formed of back plate 40. Back plate 40 is preferably no larger than front plate 20 so that it is not visible when the belt buckle is worn with the cup-holder folded in the stowed position. More preferably still, back plate 40 is cut away at the top 42 so that front plate 20 extends upwards beyond back plate 40; in this manner, it is easier for the wearer to grasp front plate 20 to fold it into the downward, cup-supporting position, as described below.

Figure 10:
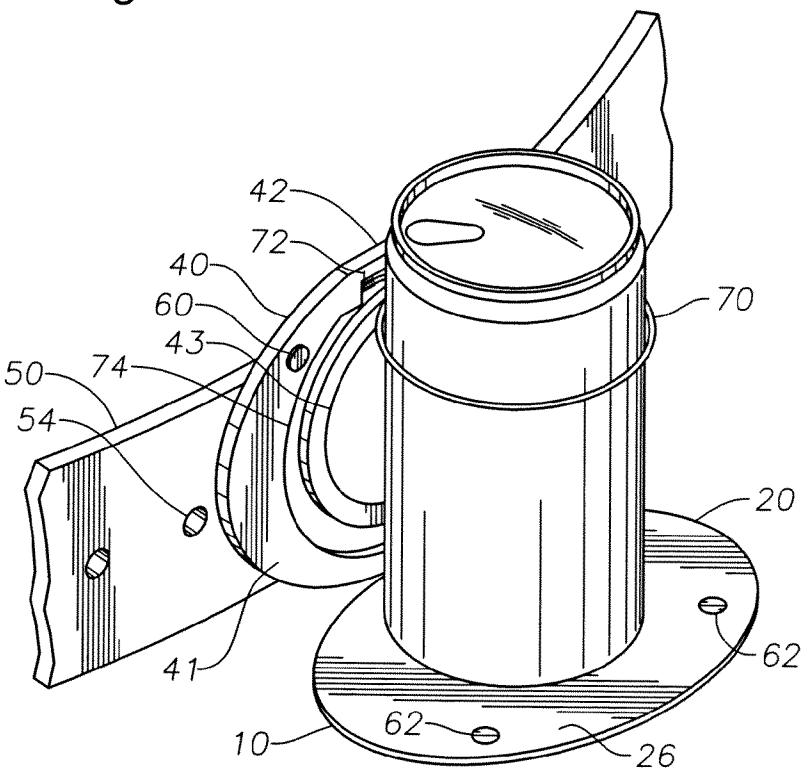
FIG. 10 is a perspective view of the belt buckle/cup-holder of FIG. 9 shown carrying a beverage container according to a preferred embodiment of the invention.
Figure 9:
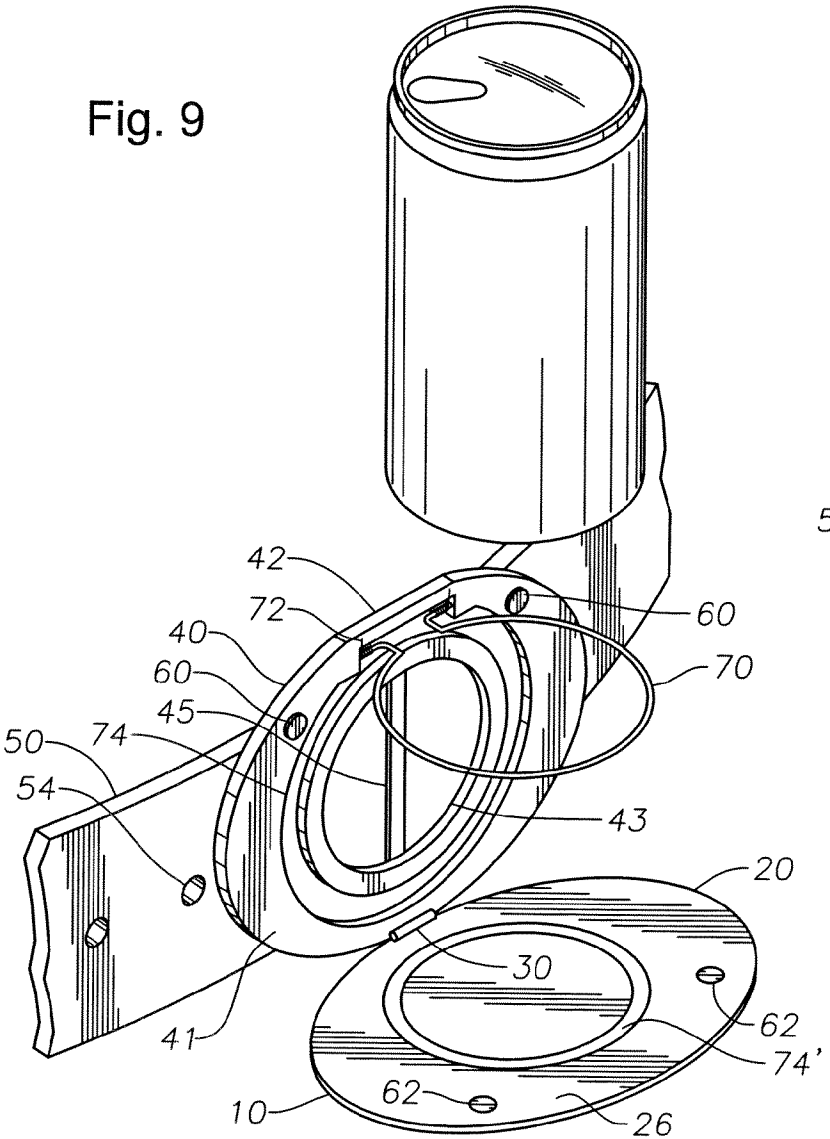
FIG. 9 is a perspective view of the belt buckle/cup-holder device of FIG. 6 shown attached to a belt strap and poised to accept a beverage container.

Attached to the back side 44 of back plate 40, or formed integrally therewith, are two brackets 46, 48. Brackets 46, 48 are preferably formed in the shape of thin, elongate loops dimensioned to receive a belt strap 50 (FIGS. 9-10). Loop 46 is positioned for the proximal end of the belt strap to pass through and be folded back upon itself, whereupon the belt strap is typically riveted or stitched together so that it is fixed to belt buckle/cup-holder 10. Bracket 48 is positioned near a hook or post 52 for receiving the distal end of the belt strap therethrough, whereupon post 52 is inserted into a desired hole 54 of belt strap 50 for securing the belt about the wearer. Post 52 may be positioned on the right side of back plate 40, as shown in FIG. 2, to accommodate male wearers, or post 52 may be positioned on the left side of back plate 40 (not illustrated) to accommodate female wearers.

Back plate 40 may include one or more apertures 43 formed therethrough for the purpose of weight reduction. As shown in FIG. 2, back plate 40 preferably includes two such semi-circular apertures 43 that define a central beam 45 and through which belt strap 50 may pass for added security, if desired.

Back plate 40 and brackets 46, 48 are preferably formed of metal or plastic materials, although other materials may be used as appropriate.

FIG. 3 illustrates a side view of belt buckle/cup-holder 10, with front plate 20 folded about hinge 30 up parallel to and abutting back plate 40. That is, front plate 20 and back plate 40 are conjoined. This configuration is the ordinary configuration of belt buckle/cup-holder 10 when the device is not being used as a cup-holder. In the configuration of FIGS. 1-3, belt buckle/cup-holder 10 appears to the casual observer to be a conventional, ornamental belt buckle, such as western-style belt buckle.

Figure 8:
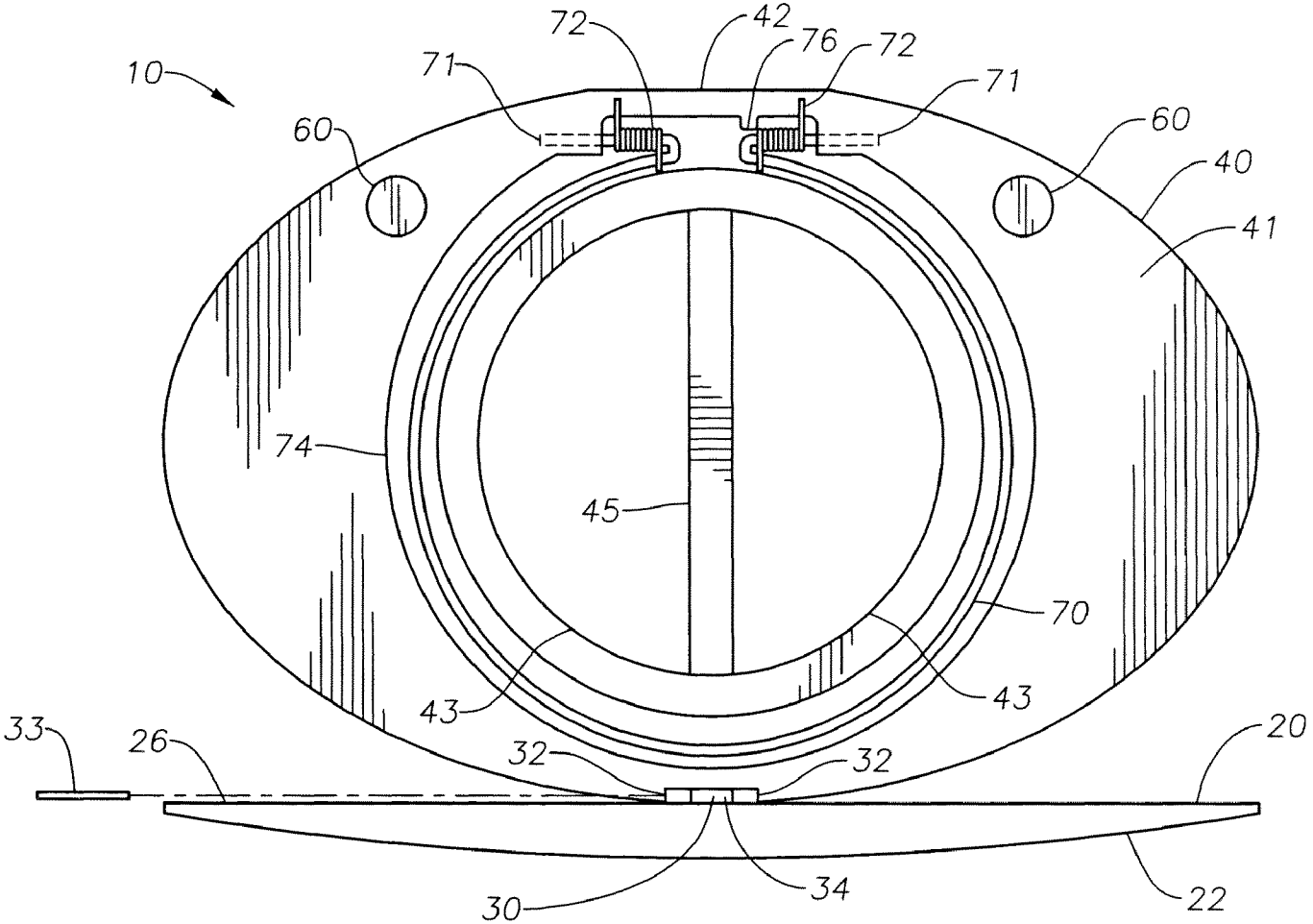
FIG. 8 is an enlarged view of the belt buckle/cup-holder device 4, illustrating detail of a spring arrangement and groove associated with the lateral support ring.

Referring to FIGS. 2, 3 and 8, hinge 30 may be a discrete hinge with its two leaves attached to front plate 20 and back plate 40, respectively, or hinge 30 may be created by having its intervaled knuckles formed integrally with the plates, which are then secured by passing a small pin 33 therethrough, as is known in the art. In the preferred embodiment, hinge 30 has three knuckles, with the outer two knuckles 32 formed as an integral part of back plate 40 and the inner knuckle 34 formed as an integral part of front plate 20. Inner knuckle 34 also forms a tab 36 that abuts against back plate 40 when front plate 20 is pivoted downward perpendicular to back plate 40, which keeps front plate 20 from swinging below the ninety degree position under the weight of a beverage.

Figure 5:
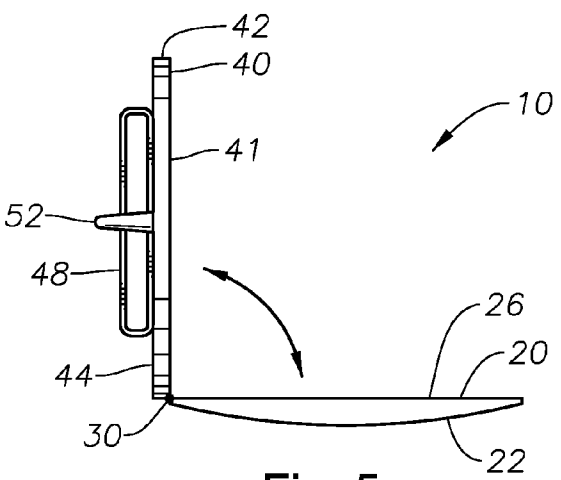
FIG. 5 is an orthogonal right side view of the belt buckle/cup-holder device of FIG. 4.
Figure 4:
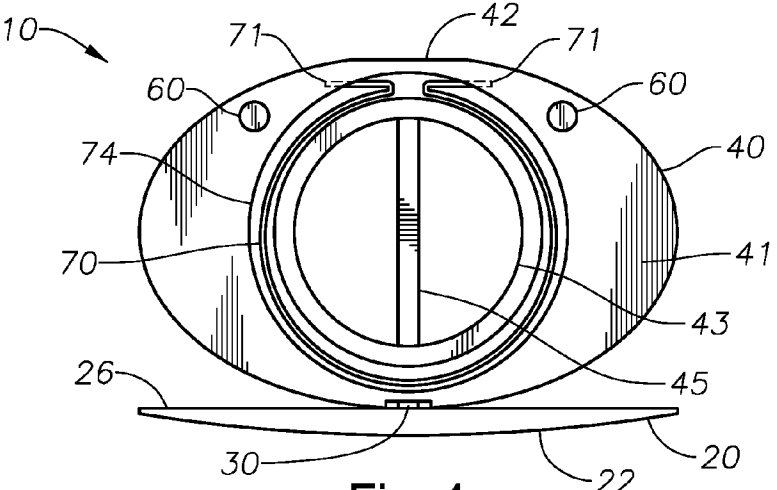
FIG. 4 is an orthogonal front view of the belt buckle/cup-holder device of FIG. 1 shown in the first stage of cup-holder deployment, with the front plate folded downward perpendicular to the back plate to form a shelf for supporting a beverage container thereon.

FIGS. 4 and 5 are front and side views, respectively, of belt buckle/cup-holder 10 in the first stage of cup-holder deployment. Front plate 20 is folded down ninety degrees about hinge 30 so that it is perpendicular to back plate 40. Hinge 30 is arranged with a tab or stop (not illustrated in FIGS. 4-5, but shown as tab 36 in FIGS. 2-3) to limit the downward travel of front plate 20 to this perpendicular position and to support the weight of a beverage container placed thereon (FIG. 10). Alternatively, the front plate 20 itself may include a tab or stop that abuts against back plate 40 to support front plate 20 in the lower, perpendicular position, or other arrangements may be used. The inner surface 26 of front plate 20 may optionally include a depression, knurling, or non-slip surface (not illustrated) to help secure a beverage container.

As shown in FIG. 4, the inner surface 41 of back plate 40 preferably includes one or more magnets 60 that secure hold front plate 20 against back plate 40 when the cup-holder is stowed, as shown in FIGS. 1 and 3. Inner surface 26 of front plate 20 also ideally includes one or more magnets 62 (FIG. 9) of opposite polarity to magnets 60. Magnets 62 are positioned so that they are adjacent to the back plate magnets 60 when the plates are folded against each other. Magnets 60 may be inset into back plate 40, and magnets 62 may be inset into front plate 20.

Alternatively, if at least one of the back plate 40 or front plate 20 are made of a magnetic material, a magnet-to-metal latch may be used instead of a magnet-to-magnet latch. However, complementary magnet pairs increase the holding power over magnet-to-metal arrangements and are necessary when the front and black plate are made of non-magnetic material. Although a magnetic latch arrangement is preferred, other mechanical latch arrangements may be used.

Figure 7:
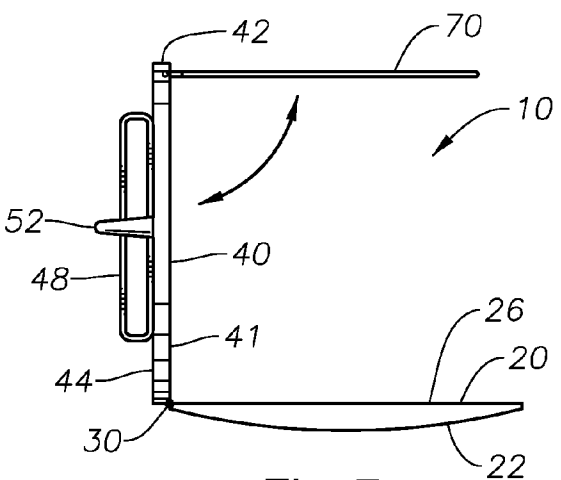
FIG. 7 is an orthogonal right side view of the belt buckle/cup-holder device of FIG. 6.
Figure 6:
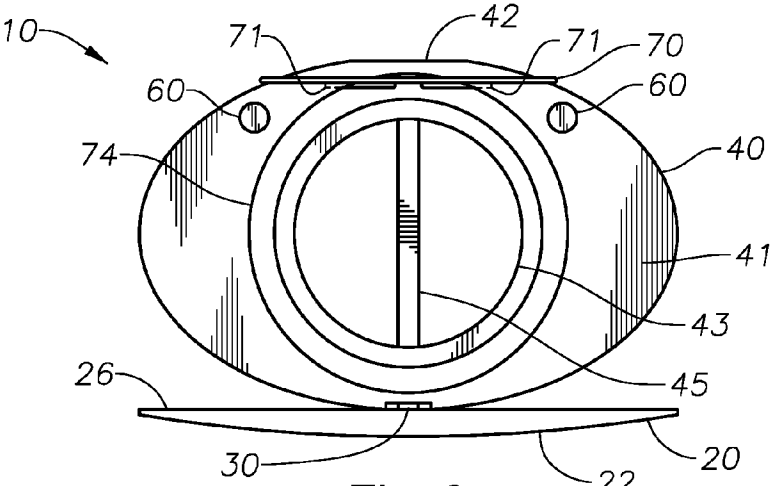
FIG. 6 is an orthogonal front view of the belt buckle/cup-holder device of FIG. 1 shown in the second and final stage of cup-holder deployment, with the front plate folded downward perpendicular to the back plate to form a lower horizontal shelf for supporting the weight of a beverage container and a ring folded upward perpendicular to the back plate to form an upper lateral support for the beverage container.

FIGS. 6 and 7 are front and side views, respectively, of belt buckle/cup-holder 10 in the second stage of cup-holder deployment. Inner surface 41 of back plate 40 carries a foldable upper support ring 70 that is used to provide lateral support to a beverage container, as shown in FIG. 10. In FIGS. 4 and 5, ring 70 is shown in the downward folded stowed position, and in FIGS. 6 and 7, ring 70 is shown in the upward extended cup-holding position.

FIG. 8 is an enlarged and more detailed view of FIG. 4. Referring to FIGS. 4-8, ring 70 is preferably formed from a thin plastic or metal wire. For example, a super-elastic wire with shape memory made from a nickel-titanium alloy may be used. Ring 70 preferably has the shape of an uppercase Greek letter Omega, so that the two ends 71 are easily attached to back plate 40 by inserting the ends 71 through slots or hinge knuckles formed in back plate 40, for example. One or more torsion springs 72 are preferably included at the ends 71 of ring 70 so that ring 70 is urged into an upward position that is perpendicular to back plate 40. The ring mounting arrangement provides a stop 76 so that as ring 70 pivots upwardly, it is limited to a position perpendicular to back plate 40. This stop function is preferably implemented by mounting ring 70 in a groove 74, as described below, so that ring 70 abuts a shoulder 76 of the groove when at the perpendicular position. It is important for ring 70 to self-deployed to the upward position, so that it is practical to place a beverage container within ring 70 without the ring falling. Although an Omega-shaped wire ring with discrete torsion springs 72 are shown, other similar arrangements may be used. For example, a torsion spring may be integral with the ring itself. As ring 70 is naturally urged upwards by spring 72, ring 70 is held in the downward stowed position only by front plate 20 being latched in the upward folded position of FIGS. 1-3.

Inner surface 41 of back plate 40 preferably includes a circular recessed slot or groove 74 for housing ring 70. Groove 74 accommodates ring 70 so that front plate 20 can be folded flush against back plate 40, as seen in FIG. 3. Although groove 74 is described and illustrated as being formed in inner side 41 of back plate 40, a groove 74' (FIG. 9) may alternatively or additionally be formed in the inner side 26 of front plate 20 for accommodating wire ring 70.

FIGS. 9 and 10 illustrate belt buckle/cup-holder 10 with the cup-holder feature deployed for receiving a beverage container. The cup-holder is deployed by the wearer placing his or her finger on the upper portion of front plate 20 that protrudes above top 42 of back plate 40. The user pushes outwards and down to fold down front plate 20. Once folded down, gravity holds front plate 20 down against the stop of hinge 30, thus keeping front plate 20 in a horizontal orientation. No longer caged by front plate 20, ring 70 pivots upwards ninety degrees under the force of spring 72. Inner surface 26 of front plate 20 supports the weight of a beverage container placed thereon, and ring 70 captures and laterally supports the beverage container.

When it is no longer desired to hold a beverage, the wearer may stow the cup-holder by first pushing and holding ring 70 downwards, then folding front plate 20 upwards parallel to and adjacent back plate 40. Magnets 60, 62 hold belt buckle/cup-holder in the stowed configuration of FIGS. 1-3.

Although belt buckle/cup-holder 10 is primarily used for supporting a beverage container, the device can also be used to hold small items such as cards, tobacco products, and other small items.

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. A buckle (10) comprising:

a back plate (40) defining inner and outer sides (41, 44), a top (42), and a bottom;

a fastener (46, 48, 52) disposed on said outer side of said back plate and arranged for connection to a belt;

a front plate (20) defining inner and outer sides (26, 22), a top, and a bottom;

a single hinge (30) pivotably connecting said bottom of said front plate to said bottom of said back plate, said hinge (30) including a first knuckle (34), which is fixated integrally with said front plate, sandwiched between second and third knuckles (32), which are formed integrally with said back plate, and a pin passing through said first, second and third knuckles; and a stop (36) formed integrally with said first knuckle that abuts said back plate so as to limit the range of pivoting of said front plate with respect to said back plate from zero degrees in a first configuration to no further than approximately ninety degrees.

2. The buckle of claim 1 further comprising:

a wire ring (70) pivotably connected to said inner side of said back plate near said top of said back plate; and a groove (74) formed in at least one of the group consisting of said inner side of said back plate and said inner side of said front plate, said groove housing said wire ring therein when said buckle is arranged in said first configuration.

3. The buckle of claim 2 wherein:

said wire ring has first and second ends (71) and is "Ω"-shaped, said first and second ends of said wire ring being pivotably received in first and second cavities formed in said back plate.

4. The buckle of claim 2 further comprising:

a spring (72) operatively coupled between said wire ring and said back plate that urges said wire ring to pivot to a perpendicular orientation with respect to said back plate.

5. The buckle of claim 4 wherein:

said groove defines a shoulder (76) that abuts said wire ring when said wire ring is positioned in said perpendicular orientation thereby preventing said wire ring from pivoting further under the influence of said spring.

6. The buckle of claim 1 further comprising:

a first magnet (60) connected to the inner side of said back plate; and a second magnet (62) connected to the inner side of said front plate so as to coincide with said first magnet when said buckle is arranged in said first configuration, said first and second magnets oriented so that their polarities cause an attractive force between said front plate and said back plate.

7. The buckle of claim 1 wherein:

said inner side of said back plate is lipless and generally planar; and said inner side of said front plate is lipless and generally planar.

8. The buckle of claim 1 wherein:

a portion of said front plate extends beyond said back plate when said buckle is arranged in said first configuration; whereby said extending portion provides an accessible surface on said inner side of said front plate for pivoting said front plate.

9. A belt (10) comprising:

a strap (50); and a buckle fastened to said strap, said buckle including, a back plate (40) defining inner and outer sides (41, 44), a top (42), and a bottom, a front plate (20) defining inner and outer sides (26, 22), a top, and a bottom, a single hinge (30) pivotably connecting said bottom of said front plate to said bottom of said back plate, said hinge (30) including a first knuckle (34), which is formed integrally with said front plate, sandwiched between second and third knuckles (32), which are formed integrally with said back plate, and a pin passing through said first, second and third knuckles, and a stop (36) formed integrally with said first knuckle that abuts said back plate so as to limit the range of pivoting of said front plate with respect to said back plate from zero degrees in a first configuration to no further than approximately ninety degrees.

10. The belt (10) of claim 9 wherein said buckle further comprises:

a wire ring (70) pivotably connected to said inner side of said back plate near said top of said back plate; and a groove (74) formed in at least one of the group consisting of said inner side of said back plate and said inner side of said front plate, said groove housing said wire ring therein when said buckle is arranged in said first configuration.

11. The belt (10) of claim 10 wherein:

said wire ring has first and second ends (71) and is "Ω"-shaped, said first and second ends of said wire ring being pivotably received in first and second cavities formed in said back plate.

12. The belt (10) of claim 10 wherein said buckle further comprises:

a spring (72) operatively coupled between said wire ring and said back plate that urges said wire ring to pivot to a perpendicular orientation with respect to said back plate.

13. The belt (10) of claim 12 wherein:

said groove defines a shoulder (76) that abuts said wire ring when said wire ring is positioned in said perpendicular orientation thereby preventing said wire ring from pivoting further under the influence of said spring.

14. The belt (10) of claim 9 wherein said buckle further comprises:

a first magnet (60) connected to the inner side of said back plate; and a second magnet (62) connected to the inner side of said front plate so as to coincide with said first magnet when said buckle is arranged in said first configuration, said first and second magnets oriented so that their polarities cause an attractive force between said front plate and said back plate.

15. The belt (10) of claim 9 wherein:

said inner side of said back plate is lipless and generally planar; and said inner side of said front plate is lipless and generally planar.

16. The belt (10) of claim 9 wherein:

a portion of said front plate extends beyond said back plate when said buckle is arranged in said first configuration; whereby said extending portion provides an accessible surface on said inner side of said front plate for pivoting said front plate.

* * * * *